US006449983B2

(12) United States Patent
Pozivil

(10) Patent No.: US 6,449,983 B2
(45) Date of Patent: Sep. 17, 2002

(54) RELIQUEFACTION OF COMPRESSED VAPOR

(75) Inventor: Josef Pozivil, Allschwil (CH)

(73) Assignee: The BOC Group, Inc., Murray Hill, NJ (US)

( * ) Notice: Subject to any disclaimer, the term of this patent is extended or adjusted under 35 U.S.C. 154(b) by 0 days.

(21) Appl. No.: 09/801,954

(22) Filed: Mar. 8, 2001

(30) Foreign Application Priority Data

Mar. 9, 2000 (GB) ..... 0005709
Jun. 16, 2000 (GB) ..... 0014868

(51) Int. Cl.[7] ..... F25J 1/00
(52) U.S. Cl. ..... 62/613; 62/614
(58) Field of Search ..... 62/611, 614, 613, 62/483

(56) References Cited

U.S. PATENT DOCUMENTS

| | | | |
|---|---|---|---|
| 3,108,446 A | 10/1963 | Sohda et al. | |
| 3,285,028 A | 11/1966 | Newton | |
| 3,800,550 A | 4/1974 | Delahunty | |
| 3,857,245 A | 12/1974 | Jones | |
| 3,874,185 A | 4/1975 | Etzbach | 62/40 |
| 3,919,852 A | 11/1975 | Jones | 62/7 |
| 4,249,387 A | 2/1981 | Crowley | |

FOREIGN PATENT DOCUMENTS

| | | | |
|---|---|---|---|
| CH | 1414508 | 11/1975 | F25J/3/00 |
| DE | 0 367 156 | 5/1990 | F25J/1/02 |
| GB | 1 471 404 | 4/1977 | |
| GB | 1472080 A | 4/1977 | |
| GB | 1472533 A | 5/1977 | |
| GB | 233149 A | 7/1999 | |
| WO | WO 94/17325 | 8/1994 | |
| WO | WO 98/43029 | 10/1998 | |

OTHER PUBLICATIONS

Patent Abstracts Of Japan, vol. 001, No. 029 (C–010)), Mar. 28, 1977 & JP 51 151264 A (Hitachi Zosen Corp), Dec. 25, 1976 *abstract*.

*Primary Examiner*—William C. Doerrler
*Assistant Examiner*—Malik N. Drake
(74) *Attorney, Agent, or Firm*—Wan Yee Cheung; Salvatore P. Pace

(57) ABSTRACT

Liquefied natural gas is stored in an insulated tank, typically forming part of an ocean going tanker. Boiled off vapour is compressed in a compressor and at least partially condensed in a condenser. The resulting condensate is returned to the tank. The vapour is mixed with liquefied natural gas in a mixing chamber upstream of the compressor. The liquefied natural gas so mixed with the vapour in the mixing chamber is taken from the condensate or from the storage tank.

14 Claims, 3 Drawing Sheets

RELIQUEFACTION OF COMPRESSED VAPOR

BACKGROUND OF THE INVENTION

This invention relates to a method and apparatus for the reliquefaction of a compressed vapour, particularly a method and apparatus which are operable on board ship to reliquefy natural gas vapour.

Natural gas is conventionally transported over large distances in liquefied state. For example, ocean going tankers are used to convey liquefied natural gas from a first location in which the natural gas is liquefied to a second location in which it is vaporised and sent to a gas distribution system. Since natural gas liquefies at cryogenic temperatures, i.e. temperatures below −100° C., there will be continuous boil-off of the liquefied natural gas in any practical storage system. Accordingly, apparatus needs to be provided in order to reliquefy the boiled-off vapour. In such an apparatus a refrigeration cycle is performed comprising compressing a working fluid in a plurality of compressors, cooling the compressed working fluid by indirect heat exchange, expanding the working fluid, and warming the expanded working fluid in indirect heat exchange with the compressed working fluid, and returning the warmed working fluid to one of the compressors. The natural gas vapour, downstream of a compression stage, is at least partially condensed by indirect heat exchange with the working fluid being warmed. One example of an apparatus for performing such a refrigerant method is disclosed in U.S. Pat. No. 3,857,245.

According to U.S. Pat. No. 3,857,245 the working fluid is derived from the natural gas itself and therefore an open refrigeration cycle is operated. The expansion of the working fluid is performed by a valve. Partially condensed natural gas is obtained.

The partially condensed natural gas is separated into a liquid phase which is returned to storage and a vapour phase which is mixed with natural gas being sent to a burner for combustion. The working fluid is both warmed and cooled in the same heat exchanger so that only one heat exchanger is required. The heat exchanger is located on a first skid-mounted platform and the working fluid compressors on a second skid-mounted platform.

Nowadays, it is preferred to employ a non-combustible gas as the working fluid. Further, in order to reduce the work of compression that needs to supplied externally, it is preferred to employ an expansion turbine rather than a valve in order to expand the working fluid.

An example of an apparatus which embodies both these improvements is given in WO-A-98/43029. Now two heat exchangers are used, one to warm the working fluid in heat exchange with the compressed natural gas vapour to be partially condensed, and the other to cool the compressed working fluid. Further, the working fluid is compressed in two separate compressors, one being coupled to the expansion turbine.

WO-A-98/43029 points out that incomplete condensation of the natural gas vapour reduces the power consumed in the refrigeration cycle (in comparison with complete condensation) and suggests that the residual vapour—which is relatively rich in nitrogen—should be vented to the atmosphere. Indeed, the partial condensation disclosed in WO-A-98/43029 follows well known thermodynamic principles which dictate that the condensate yield is purely a function of the pressure and temperature at which the condensation occurs.

Typically, the liquefied natural gas may be stored at a pressure a little above atmospheric pressure and the boil-off vapour may be partially condensed at a pressure of 4 bar. The resulting partially condensed mixture is typically flashed through an expansion valve into a phase separator to enable the vapour to be vented at atmospheric pressure. Even if the liquid phase entering the expansion valve contains as much as 10 mole per cent of nitrogen at 4 bar, the resulting vapour phase at 1 bar still contains in the order of 50% by volume of methane. In consequence, in a typical operation, some 3000 to 5000 kg of methane may need to be vented daily from the phase separator. Since methane is recognised as a greenhouse gas such a practice would be environmentally unacceptable.

It is therefore desirable to return any flash gas and any uncondensed vapour to the LNG storage tanks of the ship with the condensate. The return of vapour to the storage tanks would in turn tend to enhance the mole fraction of nitrogen in the ullage space of the storage tanks and thereby give rise to two disadvantages. First, as the concentration of nitrogen in the boil-off gas rises, so more work needs to be performed to condense a given proportion of the boil-off gas. Second, variations in the composition of the boil-off gas make the refrigeration cycle more difficult to control.

The method and invention according to the invention are aimed at mitigating the problems that are caused when vapour is returned with condensed natural gas to a liquefied natural gas (LNG) storage tank.

SUMMARY OF THE INVENTION

According to the present invention a method of reliquefying vapour boiled off from liquefied natural gas held in a storage tank comprising compressing the vapour, at least partially condensing the compressed vapour, and returning the condensate to the storage tank, wherein the boiled off vapour is mixed upstream of the compression with liquefied natural gas.

The invention also provides apparatus for reliquefying vapour boiled-off from liquefied natural gas held in a storage tank comprising, the apparatus comprising a flow circuit comprising a vapour path extending from the tank through a compressor to a condenser for at least partially condensing compressed boiled-off vapour and a condensate path extending from the condenser back to the storage tank, wherein the apparatus additionally comprises a conduit for the flow of liquefied natural gas into at least one mixer forming part of the flow circuit upstream of (i.e. on the suction side of) the compressor.

Preferably, the flow of liquefied natural gas is taken from storage, or from the condensate itself en route to storage.

There are various advantages given by the method and apparatus according to the invention. In particular since the nitrogen mole fraction in the liquefied natural gas is less than the nitrogen mole fraction in the boiled-off vapour and even less than that in flash gas formed by the expansion through the valve of the condensed boil-off vapour, dilution of the boiled-off vapour with the liquefied natural gas tends to dampen swings in the composition of the vapour phase in the storage tank that would otherwise occur were the characterising feature of the method and apparatus according to the invention to be omitted. Dilution of the vapour upstream of the compressor makes it possible to reduce fluctuations in the work of compression arising from fluctuations in the temperature of the vapour. These fluctuations arise mainly from changes in the loading of the storage tanks. Preferably, the inlet temperature of the boiled-off vapour to the compressor is maintained substantially constant. If desired, there is an absorber of liquid droplets at a position upstream of the inlet to the compressor so as to remove any residual droplets of liquid hydrocarbon arising from the mixing of the vapour with the liquefied natural gas at the second location though generally this measure will not be necessary. Mixing upstream of the compression is particularly important when the storage tank is only lightly laden with LNG, for example after the main part of the LNG has been off-loaded. During normal operation however, it is preferred to perform the mixing with a stream of LNG that is diverted from the condensation path. It then becomes unnecessary to employ any mechanical pump to withdraw LNG from storage for the purposes of temperature control.

There are a number of different preferred additional locations for effecting the mixing of the boiled-off vapour or its condensate with the liquefied natural gas. A first preferred additional location is downstream of the boiled-off vapour compressor but upstream of the inlet to the condenser for the vapour. Preferably, the mixing at this location is controlled so as to maintain a constant vapour temperature at the inlet to the condenser. By so controlling the temperature it is possible to reduce fluctuations in the demand for refrigeration of the condenser which can particularly arise from changes in the volume of liquefied natural gas being held in the storage tank.

Preferably, in order to effect the mixing at this additional location, a second mixing chamber is provided with a first inlet for the vapour and a second inlet for liquefied natural gas in finely divided form. Preferably, the second inlet has a flow control valve associated with it, the position of the second flow control valve being automatically adjustable so as to maintain the temperature of the vapour at the inlet to the condenser substantially constant.

Another preferred additional location for the mixing is downstream of the condenser. More preferably, this other additional location is downstream of an expansion valve or pressure regulating valve in the condensate path. Accordingly the pressure of the condensate is preferably reduced upstream of the other additional location.

If desired, the mixing may be performed at more than one of the above mentioned additional locations. Indeed, it is sometimes preferred that it be performed at both of the above mentioned locations in addition to upstream of the compressor, particularly when the storage is only lightly laden with LNG. During normal, fully laden operation, however, mixing need take place only at a location upstream of the compression.

Preferably, the condensate is returned to the storage tank at a position below the surface of the liquid stored therein. It is desirable to introduce gas bubbles in the returning condensate in to the liquid phase in finely divided form so as to facilitate dissolution of residual uncondensed gas or flash gas formed as a result of the passage of the condensate through the expansion valve.

Preferably, the condenser is cooled by a refrigerant flowing in an essentially closed refrigeration cycle which preferably comprises compressing a working fluid in at least one working fluid compressor, cooling the compressed working fluid by indirect heat exchange in a heat exchanger, expanding the cooled working fluid in at least one expansion turbine, warming the expanded working fluid by indirect heat exchange in the condenser, the working fluid thereby providing refrigeration to the condenser, and returning the warmed expanded working fluid through the heat exchanger to the working fluid compressor.

Preferably the apparatus according to the invention comprises a first support platform on which a first pre-assembly including the condenser is positioned and a second support platform on which a second pre-assembly is positioned, the second pre-assembly including the working fluid compressor, the expansion turbine and the heat exchanger. Alternatively the heat exchanger may form part of a third pre-assembly separate from the working fluid compressor and the expansion turbine. The second pre-assembly can be located in the engine room, or a specially ventilated cargo motor room in the deck house, of an ocean going vessel on which the apparatus is to be used. In these locations, the safety requirements that the compressor and the expansion turbine are required to meet are not as high as in other parts of the ship, for example an unventilated cargo machinery room. Preferably both pre-assemblies are mounted on respective platforms that are typically ship-mounted.

Further, by locating the working fluid compressor and the expansion turbine on the same platform as one another, they can be incorporated in to a single machine. Not only does employing a single working fluid compression/expansion machine simplify the apparatus, it also facilitates testing of the machinery prior to assembly of the apparatus according to the invention on board ship. If desired, a plurality of such compression/expansion machines may be provided in parallel, typically with only one operating at any one time. Such an arrangement enables continuous operation of the working fluid cycle even if it is needed to take a machine in operation off-line for maintenance. The first pre-assembly is preferably located in the cargo machinery room within the deck house of the ocean going vessel. The first pre-assembly preferably includes the or each chamber in which the mixing of the boiled-off natural gas vapour, either upstream or downstream of the condensation, or both, with liquid natural gas from storage is performed. Alternatively the mixing chambers can be installed on board the ship.

Preferably the working fluid compressor and the expansion turbine employ seals of a kind which minimise leakage of working fluid out of the working fluid cycle.

Accordingly, instead of conventional labyrinthine seals, either dry gas seals or floating carbon ring seals are used. Even so, it is desirable that the apparatus includes a source of make-up working fluid. By minimising the loss of working fluid, the amount of make-up working fluid that is required is similarly minimised. Since the working fluid is typically required at a pressure in the range of 10 to 20 bar (1000 to 2000 kPa) on the low pressure side of the cycle, this helps to keep down the size of any make-up working fluid compressor that might be required. If nitrogen is selected as the working fluid, a source of nitrogen which is already at the necessary pressure may be employed so as to obviate the need for any make-up working fluid compressor whatever. For example, the source of the make-up nitrogen may be a bank of compressed nitrogen cylinders or, if the ship is provided with a source of liquid nitrogen, a liquid nitrogen evaporator of a kind that is able to produce gaseous nitrogen as a chosen pressure in the range of 10 to 20 bar. Such liquid nitrogen evaporators are well known. If desired, a third pre-assembly comprising the make-up working fluid supply means on a third platform may be employed.

BRIEF DESCRIPTION OF THE DRAWINGS

The apparatus according to the invention will now be described by way of example with reference to the accompanying drawings in which.

DETAILED DESCRIPTION OF THE INVENTION

Figure 1:
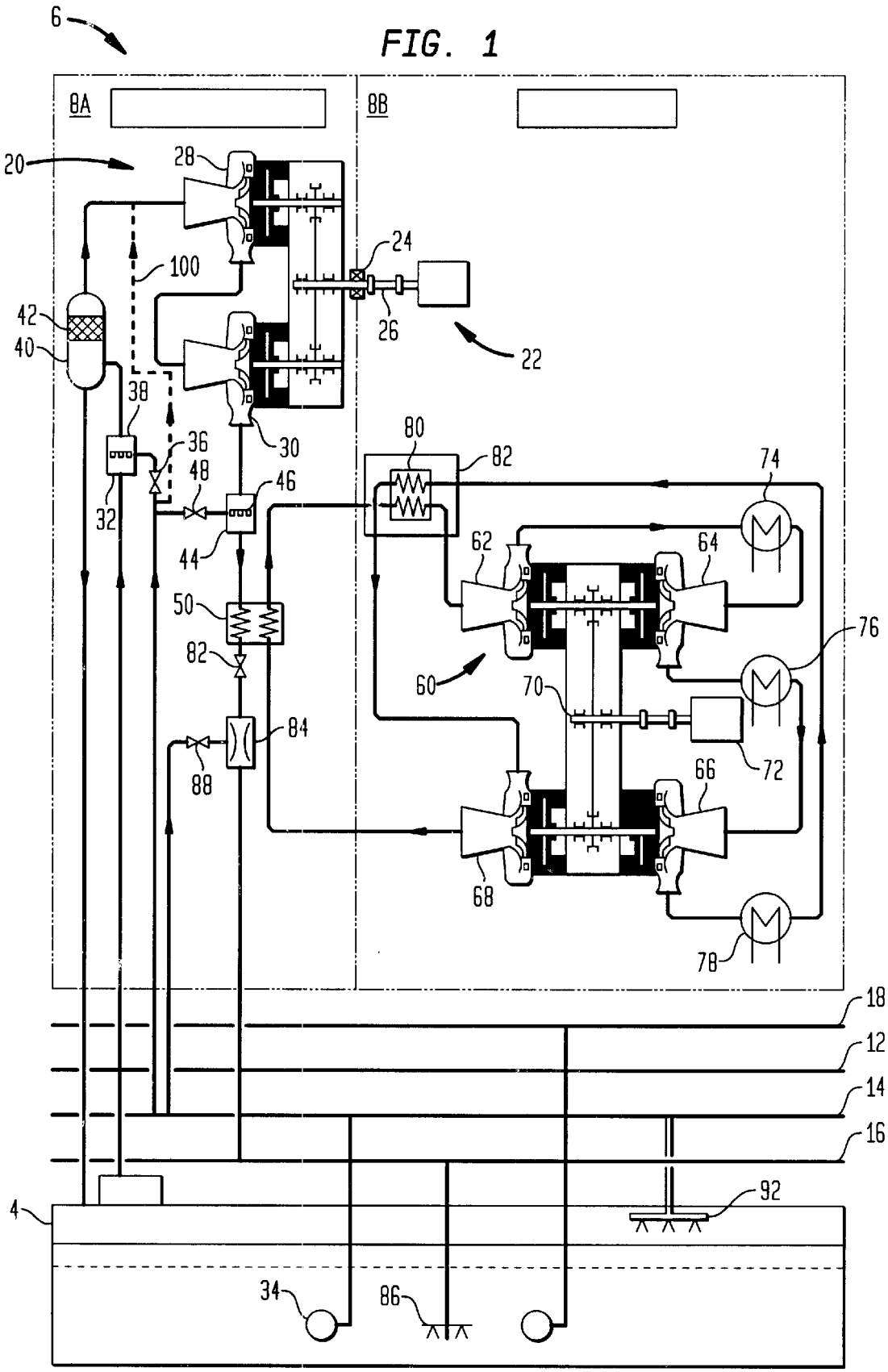
FIG. 1 is a schematic diagram of a first ship board natural gas reliquefaction apparatus.

Referring to FIG. 1 of the drawings, a ship (not shown) has in its hold thermally insulated tanks 4 (of which only one is shown) for the storage of liquefied natural gas (LNG).

Typically, the ship has two or more such tanks 4. The natural gas reliquefaction apparatus which will be described below is an apparatus that is common to all of the tanks. To this end, the tanks 4 share a common vapour header 12, a common spray liquid header 14, a common condensate return header 16, and a common liquid header 18. The spray liquid header is typically employed for cooling the tanks 4 after they have discharged a shipment of LNG to a shore-based installation. As will be described below, the spray liquid header 14 is also utilised, in accordance with the invention, in diluting vapour supplied from the vapour header 12.

As LNG boils at cryogenic temperatures, it is not practically possible to prevent continuous vaporisation of a small proportion of it from the storage tanks 4. At least the majority of the resulting vapour flows out of the top of the storage tanks 4 to the vapour header 12. The header 12 communicates with a boil-off compressor 20, typically located in a cargo machinery room 8A of a deckhouse 6 with its motor 22 located in the motor room 8B of the deckhouse 6, there being a bulkhead sealing arrangement 24 associated with the shaft 26 of the compressor 20. As shown, the compressor 20 has two stages 28 and 30 to compress the boiled-off vapour to a suitable pressure. Upstream of the inlet to the first stage 28 of the compressor 20 is a mixing chamber 32. The entire flow of the vapour to the compressor 20 passes through the mixing chamber 32. Because nitrogen is more volatile than methane, the vapour taken from the tanks 4 has a higher mole fraction of nitrogen than the liquid stored in these tanks. In order to reduce the nitrogen mole fraction of the fluid received by the boil-off compressor 20, the vapour is mixed in the mixing chamber with LNG supplied from the tanks 4. To this end, each tank 4 has a submerged LNG pump 34 operable to pump LNG at a desired elevated pressure (typically in excess of 4 bar) to the spray liquid header 14. The LNG flows from the spray liquid header 14 via a temperature control valve 36 to a spray header 38 located in the chamber 32. The mixing chamber 32 and the valve 36 are arranged so as to maintain a constant temperature at the exit of the mixing chamber 32 and hence at the inlet to the first stage 28 of the compressor 20. Thus, the valve 36 is of a kind the setting of which is able to be changed in response to temperature signals from a temperature sensor (not shown) so as to maintain the sensed temperature essentially constant. Essentially all the LNG sprayed into the mixing chamber 32 through the spray header 38 evaporates therein, thus reducing the temperature of the boiled-off vapour. The resulting mixture flows into a phase separator 40 fitted with a pad 42 of demisting absorbent so as to extract from the vapour any residual droplets of liquid. Any liquid separated in the phase separator 40 is returned to the tanks 4 by gravity.

The vapour from the phase separator 40 is compressed in the compression stages 28 and 30 of the compressor 20. The resulting compressed vapour flows from the compressor 20 to another mixing chamber 44 in which it is mixed with and chilled by a further flow of liquefied natural gas taken from the storage tanks 4 via the spray liquid header 14. The arrangement of the mixing chamber 44 is analogous to that of the mixing chamber 32. The mixing chamber 44 is thus provided with a spray header 46 supplied with the LNG through a flow control valve 48 whose operation is analogous to that of the flow control valve 36. In operation, the valve 48 is arranged so as to set the temperature at the inlet to a condenser 50. Therefore, not only does operation of the mixing chamber 44 effect a reduction in the mole fraction of nitrogen in the fluid flowing to the condenser 50, it also has the effect of controlling the inlet temperature to the condenser 50.

Refrigeration for the condenser is provided by an essentially closed working fluid refrigeration cycle. The working fluid is preferably nitrogen. Nitrogen at the lowest pressure in the cycle is received at the inlet to the first compression stage 62 of a single compression/expansion machine 60 (sometimes referred to as a "compander") having three compression stages 62, 64 and 66 in series, and downstream of the compression stage 66, a single turbo-expander 68. The three compression stages and the turbo-expander are all operatively associated with a drive shaft 70 which is driven by a motor 72. The compression-expansion machine 60 is located entirely in the cargo motor room 8B. In operation, nitrogen working fluid flows in sequence through the compression stages 62, 64 and 66 of the compression-expansion machine 60. Intermediate stages 62 and 64 it is cooled to approximately ambient temperature in a first interstage cooler 74, and intermediate compression stages 64 and 66, the compressed nitrogen is cooled in a second interstage cooler 76. Further, the compressed nitrogen leaving the final compression stage 66 is cooled in an after-cooler 78. Water for the coolers 74, 76 and 78 may be provided from the ship's own clean water circuit (not shown) and spent water from these coolers may be returned to the water purification system (not shown) of this circuit.

Downstream of the after-cooler 78 the compressed nitrogen flows through a first heat exchanger 80 in which it is further cooled by indirect heat exchange with a returning nitrogen stream. The heat exchanger 80 is located in a thermally-insulated container 82 sometimes referred to as a "cold box". The heat exchanger 80 and its thermally-insulated container 82 are, like the compression-expansion machine 60, located in the cargo motor room 8B of the ship.

The resulting compressed, cooled, nitrogen stream flows to the turbo-expander 68 in which it is expanded for the performance of external work. The external work is providing a part of the necessary energy needed to compress the nitrogen in the compression stages 62, 64 and 66. Accordingly, the turbo-expander 68 reduces the load on the motor 72. The expansion of the nitrogen working fluid to the effect of further reducing its temperature. As a result it is at a temperature suitable for the partial or total condensation of the compressed natural gas vapour in the condenser 50. The nitrogen working fluid, now heated as a result of its heat exchange with the condensing natural gas vapour, flows back through the heat exchanger 80 thereby providing the necessary cooling for this heat exchanger and from there to the inlet of the first compression stage 62 thus completing the working fluid cycle.

Although it is possible to liquefy the entire flow of natural gas through the condenser 50 only some (typically from 80 to 99%) of the natural gas is in fact condensed. The mixture of condensate and residual vapour flashes through an expansion valve 82, its pressure thereby being reduced to the pressure in the ullage space of the tanks 4. Typically, therefore, further vapour is formed by the passage of the liquid through the valve 82.

The mixture of gas and liquid passing out of the valve 82 flows into a mixer 84 which may, for example, be in the form of a venturi or other mixing device in which it is mixed with a stream of liquid taken from the spray liquid header 14. The mole fraction of the nitrogen in the natural gas mixture leaving the mixing chamber 84 is therefore less than that of the mixture leaving the valve 82. The resulting diluted mixture of LNG and natural gas vapour flows in to the condensate return header 16 and from there in to the LNG held in the storage tanks 4 through injectors 86 (only one of which is shown in the drawing). The injectors 86 are arranged so as to enable undissolved gas to be injected into the liquid in the storage tanks or in the form of fine bubbles. This arrangement facilitates the dissolution of gas, particularly when the liquid in the tanks 4 is at its normal level. The dissolution of gas is also facilitated if the injectors 86 are of a kind which create turbulence in the stored LNG. Further, the dissolution of gas in the stored LNG is also facilitated if turbulence is created in the mixture of gas and liquid flowing to the injectors 86.

Preferably, the mixing chambers 32 and 44, the condenser 50, the phase separator 40, and the mixer 84, and associated pipework are all located in a single cold box (not shown) and formed as a pre-assembly on a skid-mounted platform (not shown).

The apparatus shown in the drawing is typically operated in two distinct modes according to whether the ship is transporting a full load of LNG from a filling depot to a discharge depot or whether it is returning from the discharge depot to the filing depot. When the ship is fully laden with LNG its tanks 4 normally contain a depth of liquid natural gas in the order of 20 to 30 metres. The composition of the LNG will vary according to its source. Although the actual nitrogen content in the LNG may be relatively low, for example in the order of 0.5% by volume, the boil off gas contains in the order of 10% by volume of nitrogen. If this boil-off gas condenses at a pressure in the order of 4 bar and is flashed back into the storage tank at a pressure of about 1 bar the flash gas contains in the order of 50% by volume nitrogen. As a result, the returning flash gas tends to enrich the gas in the ullage space of the storage tanks 4 significantly in nitrogen. The amount of work in refrigerating the condenser 46 also increases significantly with increasing nitrogen content of the boil-off gas. The method and apparatus according to the invention do however counteract this tendency towards enrichment in nitrogen of the gas phase in the storage tank.

The actual pressure in the ullage space of the storage tanks is normally set by the inlet guide vanes (not shown) of the boil-off gas compressor 20. The pressure is set to be a little above 1 bar. The inlet temperature to the inlet of the compressor 20 can fluctuate quite widely, but when the storage tanks 4 are fully laden the temperature of the boil-off gas is normally in the order of −140° C., which is an acceptable inlet temperature for the boil-off gas compressor 20. In these circumstances, the valve 36 can be closed and the boil-off gas caused to by-pass the mixing chamber 32 and, if desired, the phase separator 40, and flow straight to the inlet of the compressor 20. One example of an optional by-pass path 100 is illustrated as a dashed line in FIG. 1. A substantial temperature rise is, however, caused by the compression of the gas in the two stages 28 and 30 of the boil-off gas compressor 20. The mixing chamber 44 is operated so as to reduce the temperature of the gas again to near its condensation temperature. Thus, for example, the gas may be cooled to, say, −130° C. in the mixing chamber 44. The valve 48 is set accordingly. Although the dilution of the gas in the mixing chamber 44 adds to the mass of fluid that has to be refrigerated by the closed circuit refrigeration apparatus, this increasing work is more than offset by reduction in the mole fraction of nitrogen in this fluid and by the reduction in its temperature. In addition, the pre-cooling section of the condenser 50 is smaller than it would be were the mixing in the chamber 44 to be omitted. Normally an amount of LNG at a rate up to 25% by weight, particularly between 20% and 25% by weight, of the rate of flow of boiled-off vapour is added in the mixing chamber. Typically, when the ship is fully laden from 80 to 99% by volume of the gas entering the condenser 50 is condensed therein. The resulting liquid is typically flashed to a pressure of 2 bar through the valve 82. (This pressure needs to be greater than 1 bar so as to over come the head of liquid in the storage tanks 4). Typically, the LNG supplied from the spray liquid header 14 is flashed through a valve 88 into the mixer 84. Typically, the total flow rate of LNG from storage in to the flow path is some five to ten times the original flow rate of the boiled-off vapour. By returning the fluid to the bottom of the storage tanks 4 and arranging for the gas to be introduced into the liquid in the form of fine bubbles, not all of this nitrogen will typically enter the ullage space. Instead, most of it will typically dissolve in the LNG. Accordingly, the proportion of nitrogen in the gas phase in the storage tanks 4 is kept down and the tendency for the concentration of nitrogen in the ullage space of the tanks 4 to fluctuate is also reduced.

For safety reasons, when the tanks discharge their load of LNG (via the liquid header 18) a small proportion of the LNG is retained. Typically, the depth of LNG in the tanks 4 is reduced to about 1 metre. As a result, during the voyage back to the LNG supply installation, there is a tendency for the temperature in the ullage space to be much higher than it is when the tanks 4 are fully laden. In order to counteract this tendency, there may be a continuous recirculation of LNG via the spray liquid header 14 and spray nozzles 92, at least one such nozzle being located in each tank 4, or such a recirculation at the end of its return voyage (so as to pre-cool the tanks 4 prior to their being charged with a fresh amount of LNG). Nonetheless, the temperature of the vapour in the ullage space can rise to above −100° C. Now, the mixing chamber 32 and the phase separator 40 are not by-passed and the valve 36 is set such that sufficient LNG is sprayed into the chamber 32 through the spray header 38 so as to reduce its temperature to approximately −140° C. Typically, LNG is added at this location at a rate up to 25% by weight, particularly between 20% and 25% by weight, of the rate of flow of the boiled-off gas in to the mixing chamber 32. This enables there to be made a substantial saving in the power consumed by the boil-off gas compressor 20 and the working fluid compressor 60. In other respects, the operation of the apparatus shown in the drawing is similar to when the tanks are fully charged with LNG. However, in view of the reduction in the depth of LNG in the tanks 4, very little of the gas introduced with the condensate through the injectors 86 will actually dissolve.

Whether or not the tanks are fully charged with LNG, the operation of the working fluid cycle remains substantially unaltered. The circulating nitrogen working fluid typically enters the first compression stage 62 of the working fluid compressor 60 at a temperature in the order of 20 to 40° C. in a pressure in the range of 12 to 16 bars. The nitrogen leaves the after-cooler 78 typically at a temperature in the range of 25 to 50° C. and a pressure in the range of 40 to 50 bars. It is typically cooled to a temperature in the order of −110 to −120° C. in the heat exchanger 80. It is expanded in the turbo-expander 68 to a pressure in the range of 12 to 16 bar at a temperature sufficiently low to affect the desired condensation of the natural gas in the condenser 50.

Although the nitrogen working fluid cycle is essentially closed, there is typically a small loss of nitrogen through the seals of the various compression and expansion stages of the compression-expansion machine 60. As mentioned above, such losses can be minimised by appropriate selection of seals. Nonetheless, it is still desirable to provide the closed circuit with make-up nitrogen. This is preferably at the lowest nitrogen pressure in the circuit.

Various modifications and additions may be made to the apparatus shown in the drawing. For example, the heat exchanger 80 could be located in the cargo machinery room 8A of the ship instead of the cargo motor room 8B. In another modification, diffusers can be substituted for the injectors 86.

Figure 2:
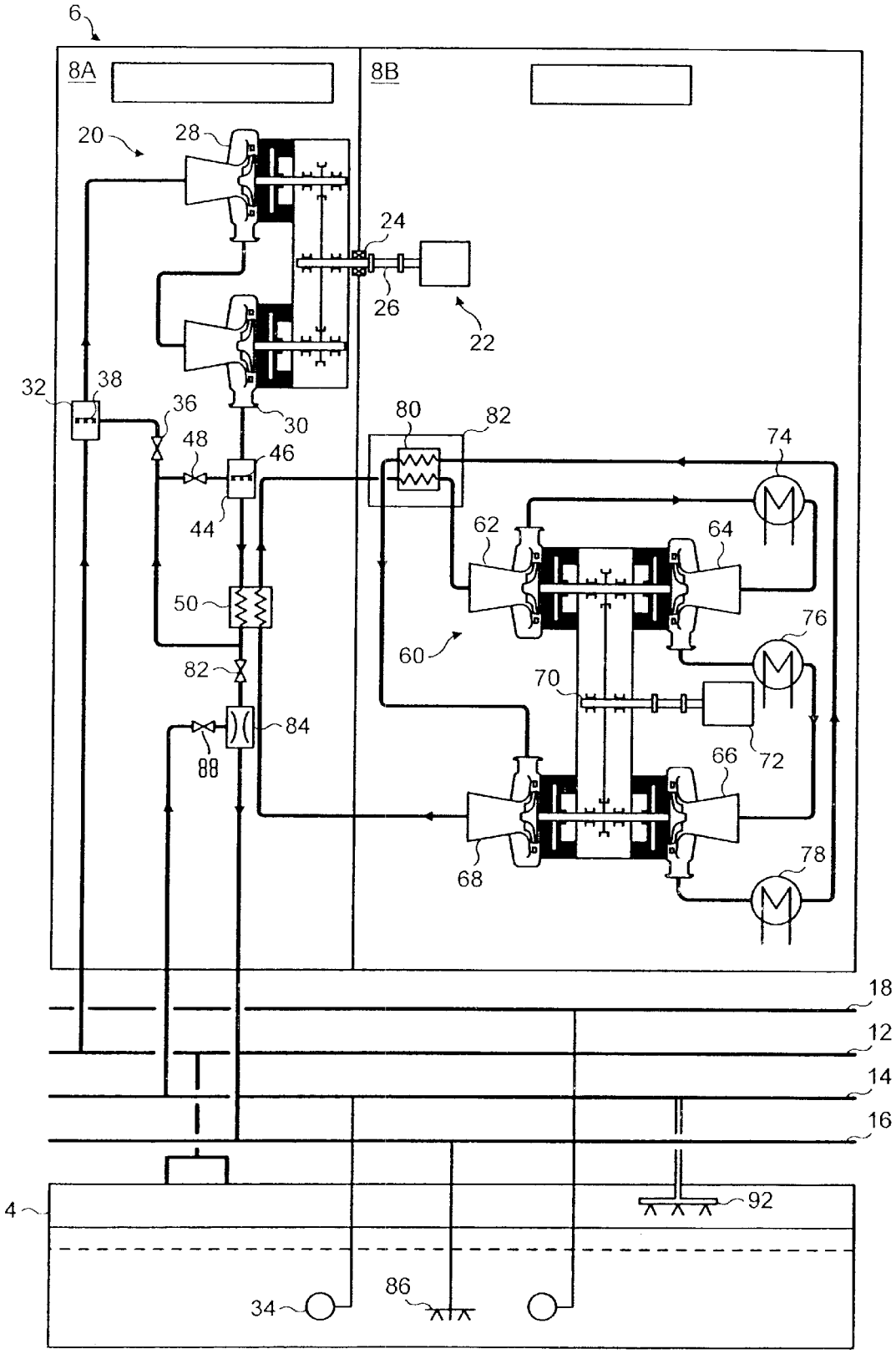
FIG. 2 is a schematic diagram of a second shipboard natural gas reliquefaction apparatus.

Another modified apparatus is shown in FIG. 2 of the accompanying drawings. The main difference between the apparatus shown in FIG. 2 and that shown in FIG. 1 is that the mixing chambers 32 and 44 are supplied with liquefied natural gas from a region of the condensate path intermediate the condenser 50 and the valve 82. As a result, during normal, fully laden, operation of the tanks 4 the pump 34 need not be operated. Therefore, there will not normally be any mixing in the mixer 84. However, during any period of operation in which the tanks 4 contain only a small amount of liquefied natural gas, the pump 34 may be actuated so as to supply LNG from storage to the mixer 84, thereby compensating in this mode of operation for the higher temperature and higher nitrogen content of the vapour to be condensed and the insufficient mixing capability of the injectors 86 in shallow liquid.

In addition, the phase separator 40 and the pad 42 present in the apparatus shown in FIG. 1 are omitted from the apparatus shown in FIG. 2. In other respects, the apparatus shown in FIG. 2 and its operation are similar to that shown in FIG. 1.

Figure 3:
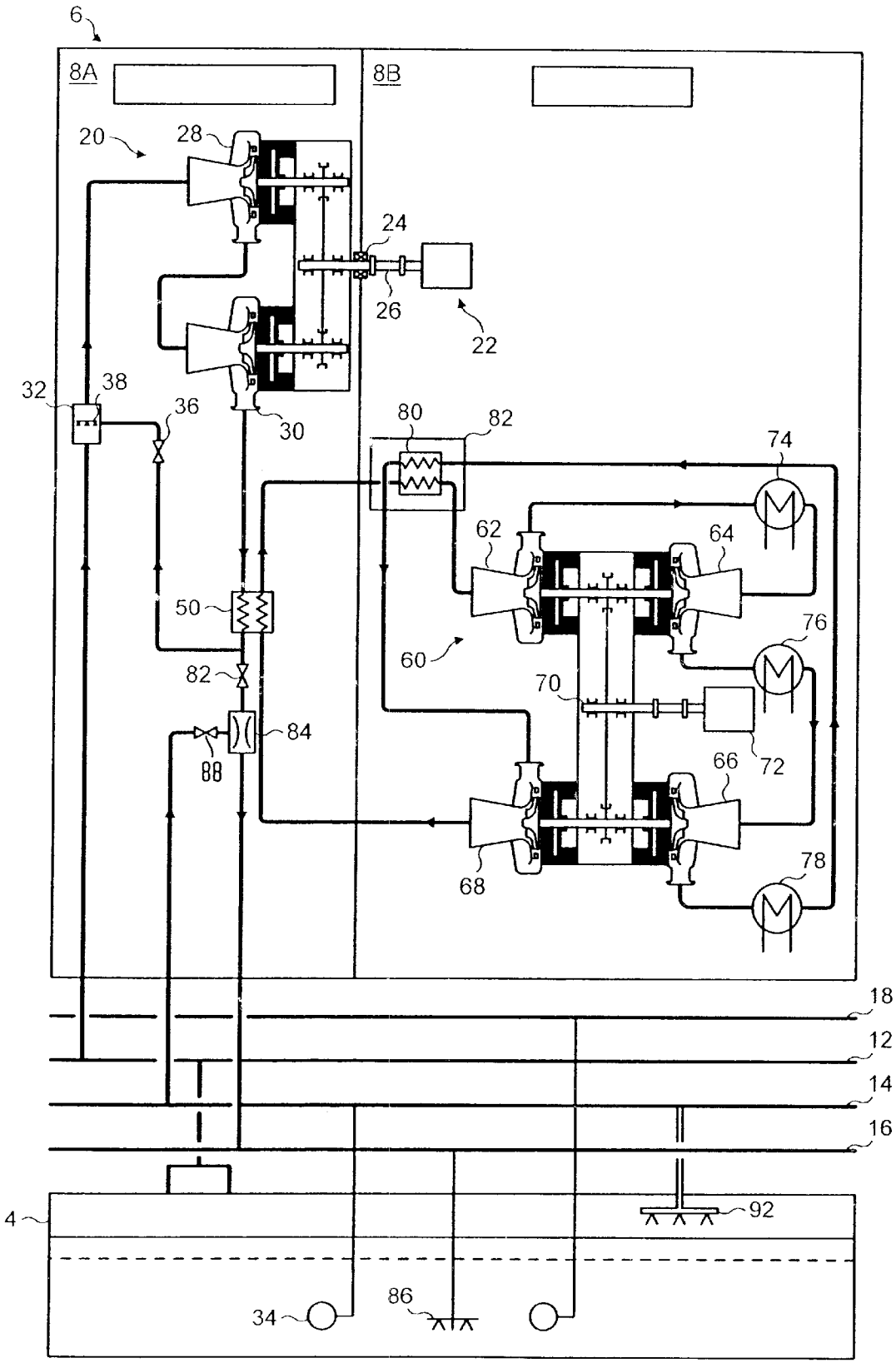
FIG. 3 is a schematic diagram of a third shipboard natural gas reliquefaction apparatus.

Referring now to FIG. 3 of the accompanying drawings, the apparatus shown therein is generally similar to that shown in FIG. 2 save that the mixing chamber 44 and its ancillary equipment are omitted. Accordingly, during normal, fully laden, operation of the tanks 4, there is mixing only in the chamber 32, but during lightly laden operation, the pump 34 is actuated and mixing takes place in the mixer 84 as well.

I claim:

1. A method of reliquefying vapour boiled off from liquefied natural gas held in a storage tank comprising compressing the vapour, at least partially condensing the compressed vapour, and returning the condensate to the storage tank, wherein the boiled off vapour is mixed with liquefied natural gas upstream of the compression.

2. The method claimed in claim 1, wherein the mixing upstream of the compression is controlled so as to keep the temperature constant at an inlet to the compression.

3. The method claimed in claim 1, wherein the boiled-off vapour is mixed, at a location downstream of the compression of the vapour but upstream of the at least partial condensation of the compressed vapour, with liquefied natural gas.

4. The method claimed in claim 3, wherein the mixing at the said location is controlled so as to maintain a constant vapour temperature at an inlet to the condensation.

5. The method claimed in claim 1, wherein the condensate is mixed with liquefied natural gas, the pressure of the condensate being reduced upstream of the mixing of the condensate with liquefied natural gas.

6. The method claimed in claim 1, wherein the condensate is returned to the storage tank at a position below the surface of the liquefied natural gas stored therein.

7. The method claimed in claim 6, wherein gas bubbles in the returning condensate are introduced in finely divided form into the liquefied natural gas held in the storage tank.

8. The method claimed in claim 1, wherein cooling for the condensation is provided by refrigerant flowing in an essentially closed refrigeration cycle.

9. Apparatus for reliquefying vapour boiled-off from liquefied natural gas held in a storage tank, the apparatus comprising a flow circuit comprising a vapour path extending from the tank through a compressor to a condenser for at least partially condensing compressed boiled-off vapour and a condensate path extending from the condenser back to the storage tank, wherein the apparatus additionally comprises a conduit for the flow of liquefied natural gas into at least one mixer forming part of the flow circuit upstream of the compressor.

10. The apparatus claimed in claim 9, wherein there is a second mixer at location downstream of the compressor but upstream of the condenser.

11. The apparatus claimed in claim 9, wherein there is a third mixer downstream of a valve for reducing the pressure of the condensate.

12. The apparatus claimed in claim 9, wherein the condensation path terminates below the surface of the liquefied natural gas in the storage tank.

13. The apparatus claimed in claim 9, wherein the conduit communicates at its inlet end with the tank.

14. The apparatus claimed in claim 9, wherein the conduit communicates at its inlet end with a region of the flow circuit downstream of the condenser.

* * * * *

UNITED STATES PATENT AND TRADEMARK OFFICE

CERTIFICATE OF CORRECTION

PATENT NO. : 6,449,983 B2
DATED : September 17, 2002
INVENTOR(S) : Josef Pozivil It is certified that error appears in the above-identified patent and that said Letters Patent is hereby corrected as shown below:

Title page,
Item [73], Assignee, delete "The BOC Group, Inc., Murray Hill, NJ (US)"
replace with -- Cryostar-France, SA,
Hesingue, France --

Signed and Sealed this

Eleventh Day of March, 2003

JAMES E. ROGAN
*Director of the United States Patent and Trademark Office*